US006712263B2

(12) United States Patent
Sun

(10) Patent No.: US 6,712,263 B2
(45) Date of Patent: Mar. 30, 2004

(54) MECHANICAL NUMERAL WHEEL COUNTER THAT CAN OUTPUT SWITCH SIGNALS AND A METHOD OF READING THE SWITCH SIGNALS

(76) Inventor: Xiaotang Sun, 70 Minzudadao Nanning, Guangxi (CN)

( * ) Notice: Subject to any disclaimer, the term of this patent is extended or adjusted under 35 U.S.C. 154(b) by 389 days.

(21) Appl. No.: 09/809,779

(22) Filed: Mar. 16, 2001

(65) Prior Publication Data

US 2002/0092902 A1 Jul. 18, 2002

(30) Foreign Application Priority Data

Apr. 23, 2000 (CN) ..... 00105255 A

(51) Int. Cl.[7] ..... G07G 1/00
(52) U.S. Cl. ..... 235/9; 235/1 C
(58) Field of Search ..... 235/1 C, 37, 42, 235/9

(56) References Cited

U.S. PATENT DOCUMENTS 5,010,334 A * 4/1991 Ponzio ..... 340/870.28

* cited by examiner

*Primary Examiner*—Karl D. Frech
(74) *Attorney, Agent, or Firm*—Greenberg Traurig, LLP; Adam B. Landa

(57) ABSTRACT

A mechanical numeral wheel counter comprising several numeral wheels and switch sensors set alternatively around the numeral wheels. The circumferences of the numeral wheels are divided into equal spaces and a sensing material is placed on each of the spaces. As the numeral wheels rotate, the status of each sensor will be different when the numeral wheel is at different position. Signals output from the sensors are processed by a computer capable of reading and recognizing the signals. A standard digital wave form can be obtained from the processed signals received by the computer from the sensors.

13 Claims, 2 Drawing Sheets

MECHANICAL NUMERAL WHEEL COUNTER THAT CAN OUTPUT SWITCH SIGNALS AND A METHOD OF READING THE SWITCH SIGNALS

CROSS-REFERENCE TO RELATED APPLICATION

This application claims priority under 35 U.S.C. 119(a) to Chinese application, serial number 00105255.1 filed Apr. 23, 2000, entitled "A KIND OF NUMERAL WHEEL COUNTER WHICH CAN OUTPUT SWITCH SIGNALS AND A METHOD OF READING THE SWITCH SIGNALS", currently pending.

FILED OF THE INVENTION

The present invention relates generally to a measuring instrument and its reading method, and more particularly to a kind of mechanical numeral wheel counter that can output switch signals and the method of reading the switch signals.

BACKGROUND OF THE INVENTION

Mechanical numeral wheel counters are typically used as measuring instruments. Some applications include kilowatt-hour meters, kilowatt-gas meters, odometers and other types of add-up measuring instruments. Because of its simplicity, stability and reliability in operation, mechanical numeral wheel counters have a long history as measuring instruments and offer a measuring method that cannot be substituted.

The development of new measuring and analysis techniques require the readings or measurements taken by the measuring instruments to be transferred remotely and/or processed by a computer. In such cases, the measurements taken by the measuring instrument should be output as an electrical signal, typically in digital format. However existing numeral wheel counters are mechanical measuring instruments, and have difficulty automatically converting the readings into an electrical signal in digital format. A method and apparatus for digitizing the output of a numeral wheel counter instrument is the problem to be solved.

Some prior art methods have attempted to resolve this problem. One method uses a pulse count for measurement. In this method, the number of rotations of the instrument is measured by optics, magnetism or syntony telepathy method. The pulse or pulse serial is digitally processed by a computer in order to total and store a value. However, there are several disadvantages with this method.

First, the measurement result is obtained by re-calculating a reading instead of reading the measurement instrument directly. The result is a two-scale measurement, one being the original mechanical measurement and the other being the added pulse measurement. The output result is thus not the actual result of the mechanical measurement, but the result of the added electrical measurement.

Second, this method is susceptible to interference by various external factors, such as the weather (thunder and or electrical storms), power supply undulation, other frequency currents and so on. This interference may affect the veracity of measurement results. In addition, the measurement errors will be cumulative and may add up extremely erroneous readings.

Thirdly, this method requires the instrument to be initialized. Since the pulse measurement is the measurement of the course, the final measurement results must be processed and stored by computer. This is inconvenient under many circumstances, such as, for example, when there are large quantities of kilowatt-hour meters to be installed.

Another problem with the pulse measurement method is the pulse measurement instrument must be operating during the actual measurement process. This causes at least two significant problems: first, the relevant electrical elements of the measurement instrument must be operated continuously, otherwise, the result of the measurement may inaccurate; second, the elements that make up the instrument, especially the sensors, may have longevity problems, since they are operating continuously.

SUMMARY OF THE INVENTION

One objective of the present invention is to provide a mechanical numeral wheel counter, which can output switch signals.

Another objective of the present invention is to provide a method of reading the switch signals output from the mechanical numeral wheel counter.

In accordance with the present invention, there is provided a mechanical numeral wheel counter, comprising one or more coaxial numeral wheels, and one or more switch sensors set alternatively around the one or more numeral wheels. The circumference of the one or more numeral wheels is divided into several equal spaces, each of the equal spaces having a sensing material applied therewith.

The circumference of the one or more numeral wheels is divided into ten equal spaces, which represent the number 0, 1, 2, 3, 4, 5, 6, 7, 8, 9. There are four sensors set around the circumference of each numeral wheel, the sensors being fixed on the outer part of the numeral wheel.

In one embodiment of the invention, the sensing material may be an absorbency material or a reflecting material.

In another embodiment of the invention the sensing material may also be a magnetic material or a magnetic induction material.

In accordance with the present invention, there is a method of reading the switch signals output from the mechanical numeral wheel counter, dividing the circumference of the numeral wheels into several equal spaces, setting the sensors around the circumference of each numeral wheel, and putting the sensing material on the said spaces. The status of each sensor will be different when the numeral wheel is at a different position. The standard digital waves can be obtained from the processed signals from the sensors, and processed by a single chip computer to read and recognize the signals from the numeral wheel.

By way of example, the absorbency material (shown in black color on FIG. 1) is put on the spaces 1, 3, 6, and 7 and the reflecting material (in white color) is put on the spaces 0, 2, 4, 5, 8, and 9. When the sensor passes the reflecting material (the shown as a white space on FIG. 1), the output signal of the sensor will be 1. When the sensor passes the absorbency material (the black space), the output signal of the sensor will be 0. The output signal from the sensor changes with the rotation of the numeral wheel. Accordingly, if the number read directly on the numeral wheel is 0, a standard digital wave from the sensors corresponding to the reading will be obtained. There is a one to one correspondent relationship between the reading on numeral wheel and the output wave from the sensors. This relationship can be shown as below:

| reading | status of sensors | output wave from sensors |
|---|---|---|
| | A B C D | AB CD |
| 0 | 1 0 1 1 | |
| 1 | 0 1 1 0 | |
| 2 | 1 1 0 0 | |
| 3 | 1 0 0 1 | |
| 4 | 0 0 1 1 | |
| 5 | 0 1 1 1 | |
| 6 | 1 1 1 0 | |
| 7 | 1 1 0 1 | |
| 8 | 1 0 1 0 | |
| 9 | 0 1 0 1 | |

As shown in the above table, the status displayed by the sensors is easily processed as an electronic digital signal. The switch signal from the sensors can be processed simply to get the standard digital square wave, which can be recognized by the single chip computer.

There are some advantages in the method mentioned above: the output of the sensors is simple, easy to recognize and anti-jamming; the output of the sensors is processed by a computer to obtain the digital display signal, thus realizing the direct electrical reading of the digits; it is convenient, and has a long life term, without cumulative errors.

DETAILED DESCRIPTION OF THE PREFERRED EMBODIMENT

Figure 1:
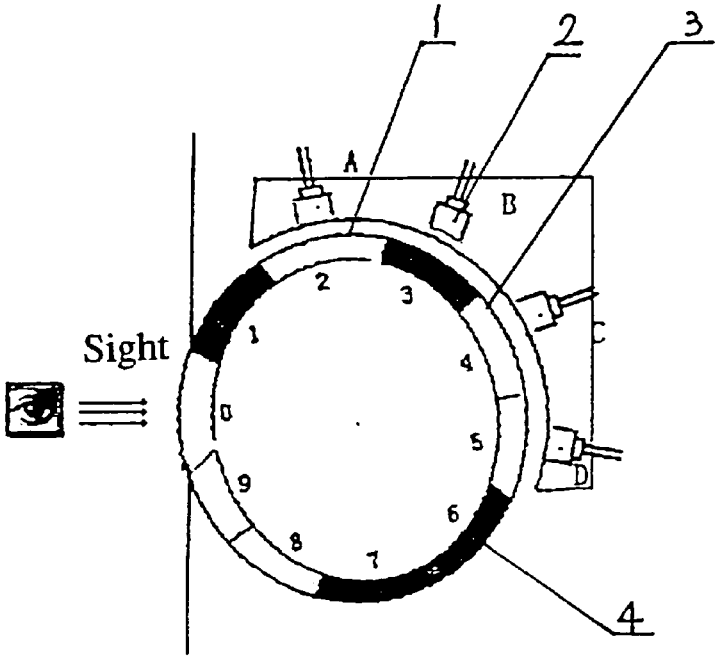
FIG. 1 is the radial section plane diagram of the numeral wheel of the counter according an embodiment of the present invention.

Referring to FIG. 1, a mechanical numeral wheel counter that can output switch signals according to one embodiment of the present invention is shown. Although the invention contemplates the use of one or more coaxial numeral wheels, a single wheel is illustrated for the purpose of example. The mechanical numeral wheel counter comprises a coaxial numeral wheel 1, one or more switch sensors 2 alternatively set around the numeral wheel 1. The circumference of the numeral wheel is divided into several equal spaces 3. Each of the equal spaces 3 has a sensing material 4.

In one embodiment of the invention, the circumference of the numeral wheel 1 is divided into ten equal spaces, which are represented by the numbers 0, 1, 2, 3, 4, 5, 6, 7, 8, and 9. The different sensing material 4 is put on the spaces 3 regularly. The sensing material 4 can be any kind of absorbency material or reflection material. In one embodiment of the invention, the sensing material is a magnetic or a magnetic induction material.

There are four switch sensors 2, identified as A, B, C, and D, set around the circumference of the numeral wheel 1. The switch sensors 2 are fixed proximal to the outer part of the numeral wheel 1. As the numeral wheel rotates, the status of each sensor 2 is different when the numeral wheel 1 is at a different position. The standard digital waves can be obtained from the processed signals from the sensors 2, and output to and processed by the single chip computer to read and display the electrical signals from the numeral wheel 1, as referred to in FIG. 2.

In one embodiment of the invention, the sensors 2 are photoelectric sensors. In another embodiment of the invention, the sensors 2 are magnetic induction sensors. In still another embodiment of the invention, the sensors 2 are inductance sensors.

There are four to eight (times 4) sensor arrays in the present invention. Each numeral wheel 1 needs four sensors 2 to recognize the number.

Figure 2:
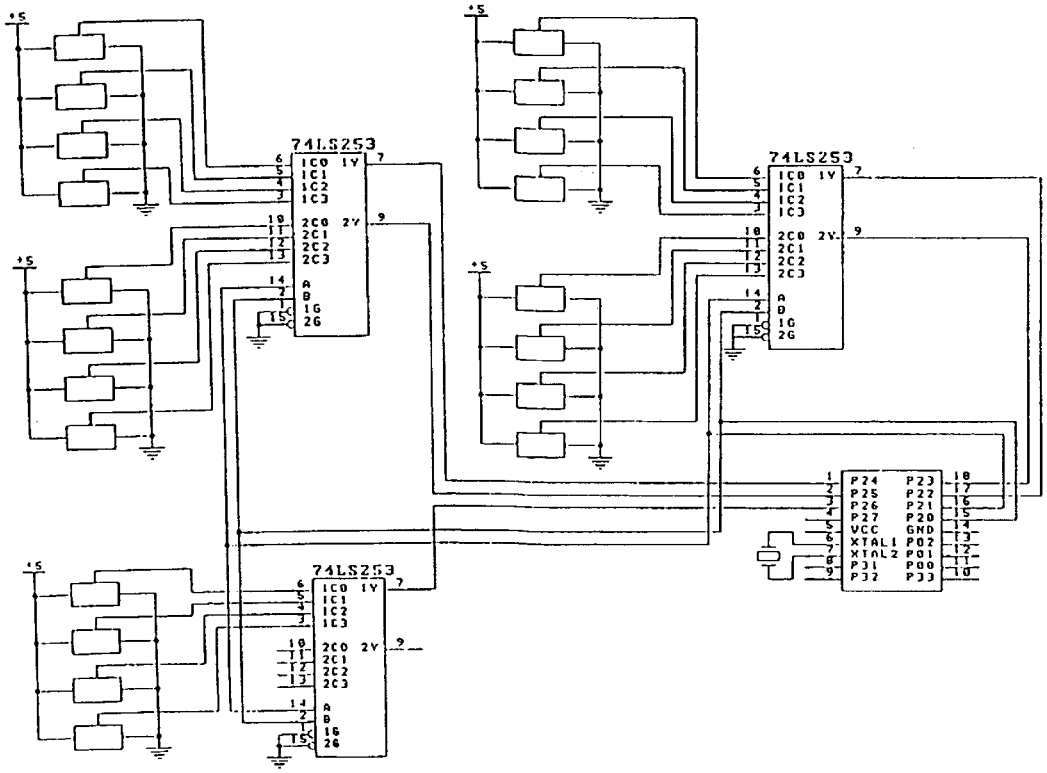
FIG. 2 is the circuit diagram of for the single chip computer that recognizes the switch signals according to an embodiment of the present invention.

Referring to FIG. 1, in accordance with the present invention, there is a method of reading the switch signals output from the mechanical numeral wheel counter. The measurement number depends on the position of the numeral wheel 1 instead of the actual reading on the numeral wheel 1. The circumference of the numeral wheel 1 is divided into several equal spaces 3. Sensors 2 are set around the circumference of each numeral wheel 1. Sensing material 4 is placed on each of the spaces 3. The status of each sensor 2 is different when the numeral wheel 1 is at different position. Referring to FIG. 2, the signals from the sensors 2 are output to and processed by a single chip computer to read and recognize the electrical signals from the numeral wheel 1. The standard digital waves can be obtained from the processed signals.

In one embodiment of the invention, there are 4 reflecting photoelectric sensors 2, identified as A, B, C, and D, recognizing 0, 1 status only. The 4 sensors are set around the circumference of each of the numeral wheel 1, the sensors are fixed on the outer part of the numeral wheel 1. Referring to FIG. 1, the circumference of the numeral wheel 1 is divided into ten equal spaces 3, which represent the number 0, 1, 2, 3, 4, 5, 6, 7, 8, and 9. The absorbency material (in black color) is put on spaces 1, 3, 6, and 7. The reflecting material (in white color) is put on spaces 0, 2, 4, 5, 8, and 9. When the sensor 2 meets the reflecting material (the white space), the output signal of the sensor will be a 1. When the sensor 2 meets the absorbency material (the black space), the output signal of the sensor will be a 0. The output signal from the sensor changes with the rotation of the numeral wheel 1.

By way of example, if the number read directly on the numeral wheel is 0, a standard digital wave from the sensors 2 corresponds to the reading. Accordingly, there is a one to one correspondent relationship between the reading on numeral wheel 1 and the output wave from the sensors 2. This relationship can be shown as follows:

| reading | status of sensors | output wave from sensors |
|---|---|---|
| | A B C D | ABCD |
| 0 | 1 0 1 1 | |
| 1 | 0 1 1 0 | |
| 2 | 1 1 0 0 | |
| 3 | 1 0 0 1 | |
| 4 | 0 0 1 1 | |
| 5 | 0 1 1 1 | |
| 6 | 1 1 1 0 | |
| 7 | 1 1 0 1 | |
| 8 | 1 0 1 0 | |
| 9 | 0 1 0 1 | |

As shown in the above table, the status of the sensors 2 can be easily processed by the computer. A standard digital square wave can be obtained by adjusting the switch signals from the sensors 2. The standard digital waves are output to and processed by the single chip computer, which reads and recognizes the electrical signals from the numeral wheel 1.

Although the present invention has been described in relation to particular preferred embodiments thereof, many variations and modifications and other uses may be made without departing from the invention. Accordingly, it is intended that all such alterations and modifications be included within the spirit and scope of the invention as defined in the appended claims.

What is claimed is:

1. A mechanical numeral wheel counter comprising:

one or more coaxial numeral wheels, the circumference of each coaxial numeral wheels being divided into several equal spaces, each of the spaces having a sensing material applied thereto; and four switch sensors, each switch sensor being set around the circumference of each of the numeral wheels.

2. The mechanical numeral wheel counter as claimed in claim 1 wherein each of the coaxial numeral wheels are divided into 10 equal spaces, the 10 equal spaces being represented by the number 0, 1, 2, 3, 4, 5, 6, 7, 8, 9.

3. The mechanical numeral wheel counter as claimed in claim 2 wherein a first sensing material is applied on the numeral wheel aligned with the spaces represented by the numbers 1, 3, 6, and 7, and a second, different sensing material is applied on the numeral wheel aligned with the spaces represented by the numbers 0, 2, 4, 5, 8, and 9.

4. The mechanical numeral wheel counter as claimed in claim 1 wherein the sensing material is an absorbency material.

5. The mechanical numeral wheel counter as claimed in claim 1 wherein the sensing material is a reflecting material.

6. The mechanical numeral wheel counter as claimed in claim 1 wherein the sensing material is a magnetic material.

7. The mechanical numeral wheel counter as claimed in claim 1 wherein the sensing material is a magnetic induction material.

8. The mechanical numeral wheel counter as claimed in claim 1 wherein, the four switch sensors are fixed proximal to the outer part of each of the numeral wheels.

9. The mechanical numeral wheel counter as claimed in claim 1 wherein the switch sensors are binary sensors.

10. A method of reading switch signals output from a mechanical numeral wheel counter, the method comprising the steps of:

dividing the circumference of the numeral wheels into ten equal spaces, the ten equal spaces representing the number 0, 1, 2, 3, 4, 5, 6, 7, 8, and 9;

setting sensors around the circumference of each of the numeral wheels;

placing a first sensing material on the numeral wheel aligned with the spaces represented by the numbers 1, 3, 6, and 7, and placing a second, different sensing material on the numeral wheel aligned with the spaces represented by the numbers 0, 2, 4, 5, 8, and 9;

reading a signal from the sensor, the status of each sensor being different for each different position of the numeral wheel;

processing the signal from the sensor by a computer, the computer being able to read and recognize the signals from the said numeral wheel and creating a standard digital wave.

11. A method of reading the switch signals output from the mechanical numeral wheel counter as claimed in claim 10 wherein, the step of placing a first sensing material on the numeral wheel aligned with the spaces represented by the numbers 1, 3, 6, and 7, and placing a second, different sensing material on the numeral wheel aligned with the spaces represented by the numbers 0, 2, 4, 5, 8, and 9, the first sensing material is absorbency material, and the second, different sensing material is reflecting material.

12. A method of reading the switch signals output from the mechanical numeral wheel counter as claimed in claim 11 wherein the step of reading a signal from the sensor comprises the steps of:

reading an output signal value of 1 when the sensor is aligned with the reflecting material; and reading an output signal value of 0 when the sensor is aligned with the absorbency material.

13. A method of reading the switch signals output from the mechanical numeral wheel counter as claimed in claim 12 wherein the step of processing the signal from the sensor by a computer comprises the step of:

determining the correspondent relationship between the reading on the numeral wheel and the output wave from the sensors.

* * * * *